US011326484B2

(12) United States Patent
Feldner et al.

(10) Patent No.: US 11,326,484 B2
(45) **Date of Patent: *May 10, 2022**

(54) SYSTEM FOR COOLING EXHAUST VALVE OF A RECIPROCATING ENGINE

(71) Applicant: AI ALPINE US BIDCO INC, Wilmington, DE (US)

(72) Inventors: Michael Feldner, Germantown, WI (US); Ryan Michael Peters, Hales Corners, WI (US); Amy Lindblad, Milwaukee, WI (US)

(73) Assignee: AI ALPINE US BIDCO INC., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/328,964

(22) Filed: May 24, 2021

(65) Prior Publication Data

US 2021/0277810 A1 Sep. 9, 2021

Related U.S. Application Data

(63) Continuation of application No. 16/889,731, filed on Jun. 1, 2020, now Pat. No. 11,041,414, which is a (Continued)

(51) Int. Cl.

| | |
|---|---|
| ***F01L 3/16*** | (2006.01) |
| ***F01L 3/12*** | (2006.01) |
| ***F01L 3/08*** | (2006.01) |
| ***F02F 1/40*** | (2006.01) |
| ***F02F 1/38*** | (2006.01) |

(52) U.S. Cl.
CPC ..... *F01L 3/16* (2013.01); *F01L 3/08* (2013.01); *F01L 3/12* (2013.01); *F02F 1/40* (2013.01); *F02F 1/38* (2013.01)

(58) Field of Classification Search
CPC ..... F01L 3/08; F01L 3/18; F01L 3/16; F02F 1/40; F02F 1/38
See application file for complete search history.

(56) References Cited

U.S. PATENT DOCUMENTS 1,712,539 A 5/1929 Willgoos
1,893,209 A 1/1933 Parkhill
(Continued)

OTHER PUBLICATIONS

VHP, Waukesha, "Service Bulletin: Intake and Exhaust Valves," Oct. 15, 2008.

*Primary Examiner* — Kevin A Lathers
(74) *Attorney, Agent, or Firm* — Fletcher Yoder, P.C.

(57) ABSTRACT

A system includes an engine head that mounts to an engine block of a reciprocating engine, and the engine head includes an intake flow path, an exhaust flow path, a coolant flow path, and first and second sealing registers disposed on opposite sides of the coolant flow path. In addition, the first and second sealing registers are configured to receive a valve guide that supports a valve stem of an exhaust valve. Moreover, the first sealing register is disposed in a wall separating the exhaust flow path and the coolant flow path. Also, a first wall portion of the wall extends between the first sealing register and an exhaust valve seat configured to receive a valve head of the exhaust valve, and a second wall portion of the wall extends from the first sealing register away from the first wall portion.

20 Claims, 5 Drawing Sheets

Related U.S. Application Data continuation of application No. 15/802,375, filed on Nov. 2, 2017, now Pat. No. 10,731,524.

(56) References Cited

U.S. PATENT DOCUMENTS

| | | | | | |
|---|---|---|---|---|---|
| 2,175,261 | A * | 10/1939 | Harbaugh | F01P 1/08 | 123/41.17 |
| 2,222,457 | A | 11/1940 | Scheibe | | |
| 2,270,990 | A | 1/1942 | Bachle | | |
| 2,578,932 | A | 12/1951 | Hinze et al. | | |
| 2,753,853 | A | 7/1956 | Hands | | |
| 3,127,880 | A | 4/1964 | Meurer et al. | | |
| 3,345,976 | A | 10/1967 | Pope et al. | | |
| 3,998,199 | A | 12/1976 | Melchior | | |
| 4,200,066 | A * | 4/1980 | Berchtold | F01P 3/14 | 123/41.31 |
| 4,640,234 | A | 2/1987 | Olsson et al. | | |
| 5,697,344 | A | 12/1997 | Ikari | | |
| 7,997,248 | B2 | 8/2011 | Rexavier et al. | | |
| 10,731,524 | B2 * | 8/2020 | Feldner | F01L 3/16 | |
| 2002/0170510 | A1 * | 11/2002 | Iizuka | F02B 75/20 | 123/41.84 |

* cited by examiner

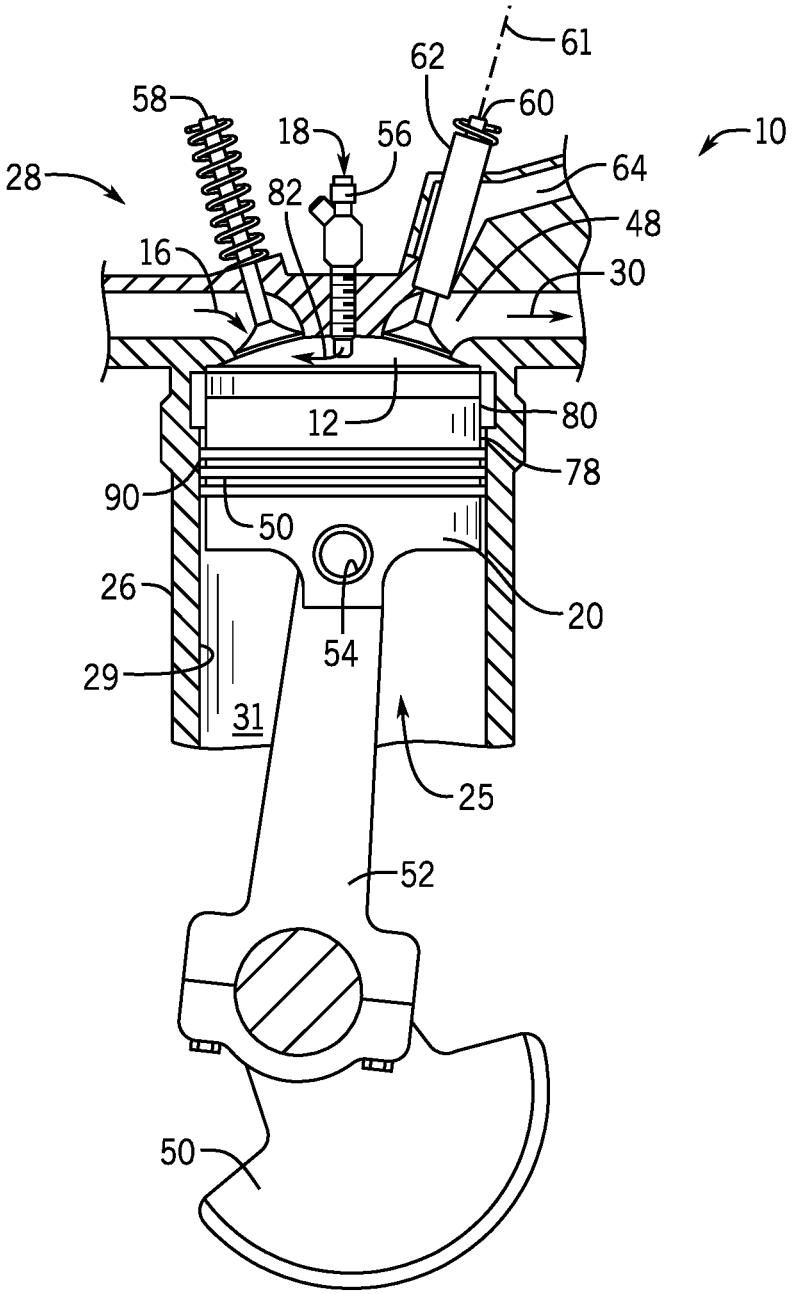
FIG. 2
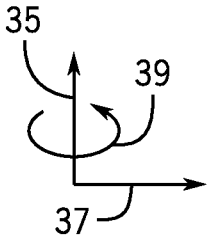

SYSTEM FOR COOLING EXHAUST VALVE OF A RECIPROCATING ENGINE

CROSS-REFERENCE TO RELATED APPLICATIONS

This application is a continuation of U.S. application Ser. No. 16/889,731, filed Jun. 1, 2020, entitled: "SYSTEM FOR COOLING EXHAUST VALVE OF A RECIPROCATING ENGINE," which is hereby incorporated by reference in its entirety, which is a continuation of U.S. application Ser. No. 15/802,375, filed Nov. 2, 2017, entitled: "SYSTEM FOR COOLING EXHAUST VALVE OF A RECIPROCATING ENGINE," which is hereby incorporated by reference in its entirety.

BACKGROUND

The subject matter disclosed herein relates generally to reciprocating engines, and, more particularly to exhaust valves of a reciprocating engine.

A reciprocating engine (e.g., a reciprocating internal combustion engine) combusts fuel with an oxidant (e.g., air) to generate hot combustion gases, which in turn drive a piston (e.g., a reciprocating piston) within a cylinder of a cylinder head. In particular, the hot combustion gases expand and exert a pressure against the piston that linearly moves the piston from a top portion to a bottom portion of the cylinder during an expansion stroke. The piston converts the pressure exerted by the combustion gases and the piston's linear motion into a rotating motion (e.g., via a connecting rod and a crankshaft coupled to the piston) that drives one or more loads (e.g., an electrical generator). The cylinder head also includes intake and exhaust valves, which open and close to control the intake of air and exhaust of combustion gases during operation of the reciprocating engine. Unfortunately, the exhaust valves are subject to considerable heat from the combustion process, and this heat can lead to degradation and coking of the lubricant used for the exhaust valves. Therefore, it would be desirable to improve the cooling and lubrication associated with the exhaust valves.

BRIEF DESCRIPTION

Certain embodiments commensurate in scope with the originally claimed disclosure are summarized below. These embodiments are not intended to limit the scope of the claimed embodiments, but rather these embodiments are intended only to provide a brief summary of possible forms of the disclosure. Indeed, the disclosure may encompass a variety of forms that may be similar to or different from the embodiments set forth below.

In a first embodiment, a system includes an engine head that mounts to an engine block of a reciprocating engine, and the head includes an intake flow path, an exhaust flow path, a coolant flow path, and first and second sealing registers disposed on opposite sides of the coolant flow path. In addition, the first sealing register is disposed in a wall separating the exhaust flow path and the coolant flow path. Moreover, a first wall portion of the wall extends between the first sealing register and an exhaust valve seat, and a second wall portion of the wall extends from the first sealing register away from the first wall portion. The head further includes a valve guide that mounts in the engine head along the coolant flow path, and the valve guide includes an annular guide body having a central axis. Also, the annular guide body includes an annular cooling portion disposed axially between first and second annular mounting portions, and the annular cooling portion is configured to extend into the coolant flow path. Moreover, the first and second annular mounting portions are configured to mount in the respective first and second sealing registers on opposite sides of the coolant flow path. In addition, the annular cooling portion has a diameter that is smaller than first and second diameters of the respective first and second annular mounting portions, and the annular cooling portion has a wall thickness that is smaller than first and second wall thicknesses of the respective first and second annular mounting portions. The valve guide also includes a valve bore extending through the annular guide body along the central axis, and the valve bore is configured to receive a valve stem of an exhaust valve having a valve head configured to open and close against the exhaust valve seat in the engine head.

In a second embodiment, a system includes a valve guide that mounts in an engine head of a reciprocating engine along a coolant flow path, and the valve guide includes an annular guide body having a central axis. Further, the annular guide body includes an annular cooling portion disposed axially between first and second annular mounting portions. In addition, the annular cooling portion extends into the coolant flow path, and the first and second annular mounting portions are configured to mount in respective first and second sealing registers on opposite sides of the coolant flow path. Moreover, the annular cooling portion has a diameter that is smaller than first and second diameters of the respective first and second annular mounting portions, and the annular cooling portion has a wall thickness that is smaller than first and second wall thicknesses of the respective first and second annular mounting portions. The valve guide also includes a valve bore extending through the annular guide body along the central axis, wherein the valve bore is configured to receive a valve stem of an exhaust valve having a valve head configured to open and close against an exhaust valve seat in the engine head.

In a third embodiment, a system includes an engine head that mounts to an engine block of a reciprocating engine, and the engine head includes an intake flow path, an exhaust flow path, a coolant flow path, and first and second sealing registers disposed on opposite sides of the coolant flow path. In addition, the first and second sealing registers are configured to receive a valve guide that supports a valve stem of an exhaust valve. Moreover, the first sealing register is disposed in a wall separating the exhaust flow path and the coolant flow path. Also, a first wall portion of the wall extends between the first sealing register and an exhaust valve seat configured to receive a valve head of the exhaust valve, and a second wall portion of the wall extends from the first sealing register away from the first wall portion. Further, the first wall portion includes a bump disposed along the coolant flow path adjacent the first sealing register. In addition, the second wall portion is oriented at an angle relative to a central axis through the first and second sealing registers, and the angle is approximately 23 to 27 degrees.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein:

FIG. 2 is a cross-sectional side view of an embodiment of a cylinder head of a reciprocating engine, illustrating a piston disposed in a cylinder, an intake valve, and an exhaust valve;

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

The disclosed embodiments relate to power cylinder systems for reciprocating engines (e.g., reciprocating internal combustion engines). Each power cylinder system has a piston configured to move linearly within a cylinder (e.g., a liner) to convert pressure exerted by combustion gases and the piston's linear motion into a rotating motion to power one or more loads. For example, the reciprocating engine may include 1, 2, 4, 6, 8, 10, 12, or more power cylinder systems, which may be disposed in a common engine head or separate engine heads. In operation, each power cylinder system routes an exhaust flow (e.g., combustion gases) out of the cylinder through one or more exhaust flow paths (e.g., exhaust flow passages or ports). Each exhaust port includes an exhaust valve that selectively opens and closes the exhaust port during operation of the reciprocating engine. Further, each exhaust valve may include an exhaust valve guide, which axially guides movement of the exhaust valve along its axis and provides lateral support. The exhaust gases exiting the cylinder still contain a high amount of heat. In reciprocating engines operating with stoichiometric combustion, the exhaust gases may contain an even greater amount of heat. The disclosed embodiments provide an engine head, exhaust valve, and exhaust valve guide with improved cooling, reduced heat degradation and coking of lubricant, increased life of parts, and increased performance.

Figure 1:
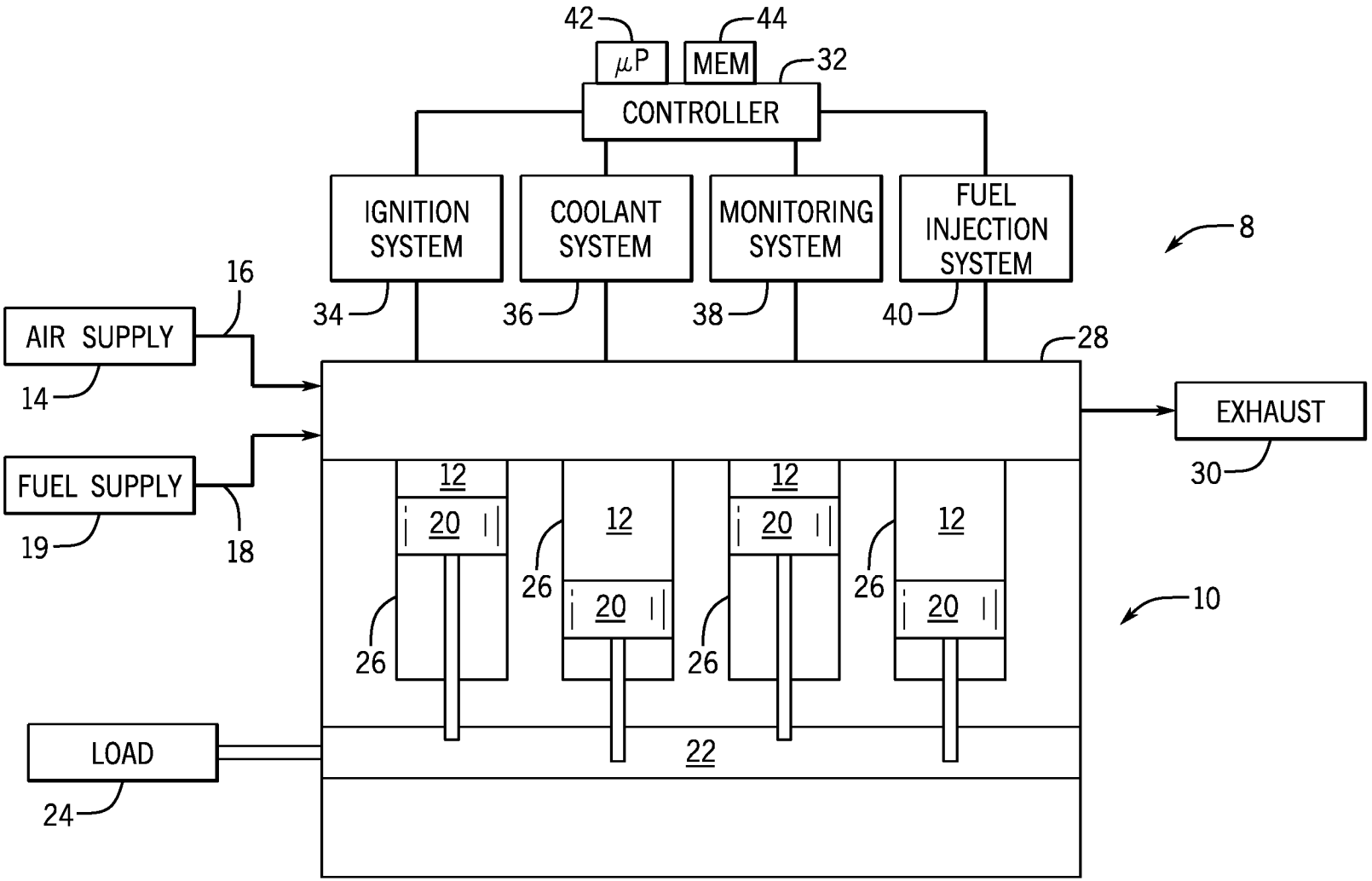
FIG. 1 is a schematic block diagram of an embodiment of a portion of an engine driven power generation system.

FIG. 1 illustrates a schematic diagram of an embodiment of a portion of an engine driven power generation system 8, which may include various improvements in the engine head, exhaust valve, exhaust valve guide, and cooling features as discussed in further detail below. The system 8 includes an engine 10 (e.g., a reciprocating internal combustion engine) having one or more combustion chambers 12 (e.g., 1, 2, 3, 4, 5, 6, 7, 8, 10, 12, 14, 16, 18, 20, or more combustion chambers 12). An air supply 14 is configured to provide a pressurized oxidant 16, such as air, oxygen, oxygen-enriched air, oxygen-reduced air, or any combination thereof, to each combustion chamber 12. The combustion chamber 12 is also configured to receive a fuel 18 (e.g., a liquid and/or gaseous fuel) from a fuel supply 19, and a fuel-air mixture ignites and combusts within each combustion chamber 12. The hot pressurized combustion gases cause a piston 20 adjacent to each combustion chamber 12 to move linearly within a cylinder 26 and convert pressure exerted by the gases into a rotating motion, which causes a shaft 22 (e.g., crankshaft) to rotate. The engine 10 also includes an engine head 28 that may be utilized to provide the oxidant 16 and fuel 18 to the cylinders 26. In addition, the engine head 28 may include passages that enable an exhaust 30 to exit the engine 10. The engine head 28 may also include one or more engine heads. For example, the engine head 28 may include an engine head for each cylinder 26, or the engine head 28 may include one engine head (i.e., a single unitary engine head) for multiple cylinders 26 (e.g., 2, 3, 4, 5, 6, or more cylinders per engine head). Further, the shaft 22 may be coupled to a load 24, which is powered via rotation of the shaft 22. For example, the load 24 may be any suitable device that may generate power via the rotational output of the system 10, such as an electrical generator. Additionally, although the following discussion refers to air as the oxidant 16, any suitable oxidant may be used with the disclosed embodiments. Similarly, the fuel 18 may be any suitable gaseous fuel, such as natural gas, associated petroleum gas, propane, biogas, sewage gas, landfill gas, coal mine gas, for example.

The engine driven power generation system 8 may also include a controller 32 (e.g., an electronic and/or processor-based controller) to govern operation of the system 8. The controller 56 may independently control operation of the system 8 by electrically communicating with an ignition system 34, a coolant system 36, a monitoring system 38, and/or a fuel injection system 40. The ignition system 34 may be used to control the ignition of the oxidant 16 and fuel 18 mixture in the cylinders 26. For example, the ignition system 34 may include temperature sensors, pressure sensors, position sensors (e.g., sensors that monitor a position of the piston 20 or the shaft 22), and an ignition device (e.g., a spark plug, a glow plug, etc.) to ignite the oxidant 16 and fuel 18 mixture. The coolant system 36 may be used to remove heat from the engine 10 by flowing a coolant (e.g., a liquid such as water) through passages in the engine. For example, the coolant system 36 may include a coolant supply and a coolant pump (e.g., an electrically actuated or belt driven pump) that provides a coolant flow through the engine 10. The monitoring system 38 may be used to monitor various aspects of the engine 10. For example the monitoring system 38 may include sensors throughout the engine that send data (e.g., mass air flow sensors, knock sensors, coolant temperature sensors, oil temperature sensors, oil level sensors, etc.) to the monitoring system 38. The monitoring system 38 may utilize the data provided by the sensors to determine a status of the engine 10, to display the data via a graphical user interface to an operator, etc. The fuel injection system 40 may be used to provide the fuel 18 to the cylinders 26. For example, the fuel injection system 40 may include one or more fuel pumps (e.g., an electrically actuated or belt driven pump), fuel injectors, carburetors, etc. to provide fuel 18 to the cylinders 26.

The controller 32 may include a distributed control system (DCS) or any computer-based workstation that is fully or partially automated. For example, the controller 32 may include a processor(s) 42 (e.g., a microprocessor(s)) that may execute software programs to perform the disclosed techniques. Moreover, the processor 42 may include multiple microprocessors, one or more "general-purpose" microprocessors, one or more special-purpose microprocessors, and/or one or more application specific integrated circuits (ASICS), or some combination thereof. For example, the processor 42 may include one or more reduced instruction set (RISC) processors. The controller 32 may include a memory device 44 for storing instructions executable by the processor 42. Data stored on the memory device 44 may include, but is not limited to, knock detection algorithm, coolant temperature parameters, oil temperature parameters, coolant flow rate parameters, oil flow rate parameters, fuel flow rate parameters, etc. of the system 8. The memory device 44 may include a tangible, non-transitory, machine-readable medium, such as a volatile memory (e.g., a random access memory (RAM)) and/or a nonvolatile memory (e.g., a read-only memory (ROM), flash memory, a hard drive, or any other suitable optical, magnetic, or solid-state storage medium, or a combination thereof). Further, the controller 32 may include multiple controllers spread out across the system 8 (e.g., each of the ignition system 34, the coolant system 36, the monitoring system 38, and the fuel injection system 40 may include one or more controllers).

The system 8 disclosed herein may be adapted for use in stationary applications (e.g., in industrial power generating engines) or in mobile applications (e.g., cars, ships, locomotives, or aircraft). The engine 10 may be a two-stroke engine, three-stroke engine, four-stroke engine, five-stroke engine, or six-stroke engine. The engine 10 may also include any number of combustion chambers 12, pistons 20, and associated cylinders (e.g., 1-24). For example, in certain embodiments, the system 8 may include a large-scale industrial reciprocating engine having 4, 6, 8, 10, 16, 24 or more pistons 20 reciprocating in cylinders 26. In some such cases, the cylinders and/or the pistons 20 may have a diameter of between approximately 13.5-34 centimeters (cm). In some embodiments, the cylinders and/or the pistons 20 may have a diameter of between approximately 10-40 cm, 15-25 cm, or about 15 cm. The system 8 may generate power ranging from 10 kW to 10 MW. In some embodiments, the engine 10 may operate at less than approximately 1800 revolutions per minute (RPM). In some embodiments, the engine 10 may operate at less than approximately 2000 RPM, 1900 RPM, 1700 RPM, 1600 RPM, 1500 RPM, 1400 RPM, 1300 RPM, 1200 RPM, 1000 RPM, or 900 RPM. In some embodiments, the engine 10 may operate between approximately 800-2000 RPM, 900-1800 RPM, or 1000-1600 RPM. In some embodiments, the engine 10 may operate at approximately 1800 RPM, 1500 RPM, 1200 RPM, 1000 RPM, or 900 RPM. Exemplary engines 10 may include General Electric Company's Jenbacher Engines (e.g., Jenbacher Type 2, Type 3, Type 4, Type 6 or J920 FleXtra) or Waukesha Engines (e.g., Waukesha VGF, VHP, APG, 275GL), for example.

FIG. 2 is a side cross-sectional view of an embodiment of a piston assembly 25 having a piston 20 disposed within a cylinder 26 (e.g., an engine cylinder) of the reciprocating engine 10. The cylinder 26 has an inner annular wall 29 defining a cylindrical cavity 31. The piston 20 may be described with reference to an axial axis or direction 35, a radial axis or direction 37, and a circumferential axis or direction 39. As shown, the piston 20 is attached to a crankshaft 50 via a connecting rod 52 and a pin 54. The crankshaft 50 translates the reciprocating linear motion of the piston 24 into a rotating motion. A fuel injector 56 provides the fuel 18 to the combustion chamber 12 and an intake valve 58 (e.g., air intake valve) opens and closes to control the delivery of air 16 to the combustion chamber 12. The fuel 18 mixes with the air 16 in the combustion chamber 12, and combusts to drive linear motion of the piston 24 in the cylinder 26. In operation, the piston 20 moves in a reciprocating manner (e.g., back and forth) in the axial direction 34 within the cavity 30 of the cylinder 26, thereby driving rotation of the crankshaft 50 and powering the load 24 (see FIG. 1) as discussed above. An exhaust valve 60, which is supported by an exhaust valve guide 62 along its axis, opens and closes an exhaust port or passage 48 to control discharge of exhaust 30 (e.g., hot products of combustion of the fuel 18 with air 16) from the engine 10. In some embodiments, the combustion chamber 12 may include more than one exhaust port 48 for the exhaust 30, such as 2, 3, 4, or more outlets. As such, the reciprocating engine 10 may include multiple exhaust valves 60 and exhaust valve guides 62, with each exhaust port 48 having a corresponding exhaust valve 60 and exhaust vale guide 62.

The heat of combustion transfers a significant amount of heat to all parts along the hot path of the combustion gases or exhaust 30. In certain embodiments, the engine 10 may be controlled by the controller 32 to operate with stoichiometric combustion, which produces exhaust 30 with a higher temperature and pressure than non-stoichiometric combustion. The exhaust valve 60, which is subject to considerable heat from the exhaust 30, includes the exhaust valve guide 62 to help guide and cool the valve 60. In operation, the exhaust valve guide 62 helps guide the exhaust valve 60 to move linearly along its axis 61 between an open valve position and a closed valve position relative to an exhaust port or passage 48. In certain embodiments, the exhaust valve guide 62 extends at least partially or entirely around an outer circumference of the exhaust valve 60. For example, the exhaust valve guide 62 may be an annular exhaust valve guide 62 and/or include an annular support sleeve. The exhaust valve guide 62 provides lateral support for the exhaust valve 60, and thus blocks lateral movement of the exhaust valve 60 away from the axis 61. In addition, the exhaust valve guide 62 is configured to help improve cooling and lubrication of the exhaust valve 60.

When the exhaust 30 exits the combustion chamber 12 through the exhaust passage 48 at a high temperature and pressure, the exhaust transfers a portion of that heat to the exhaust valve 60 and exhaust valve guide 62. Accordingly, a coolant passage 64 is included in the engine head 28 to provide a coolant flow to the exhaust valve guide 62, which helps to transfer heat away from the exhaust valve 60 and the exhaust valve guide 62 to the coolant flow. The disclosed embodiments are configured to increase the heat transfer away from the valve 60 and guide 62 to the coolant flow, thereby increasing cooling, reducing thermal degradation and coking of the lubricant, increasing the life of the valve 60 and guide 62, and improving the overall performance of the engine 10.

Figure 3:
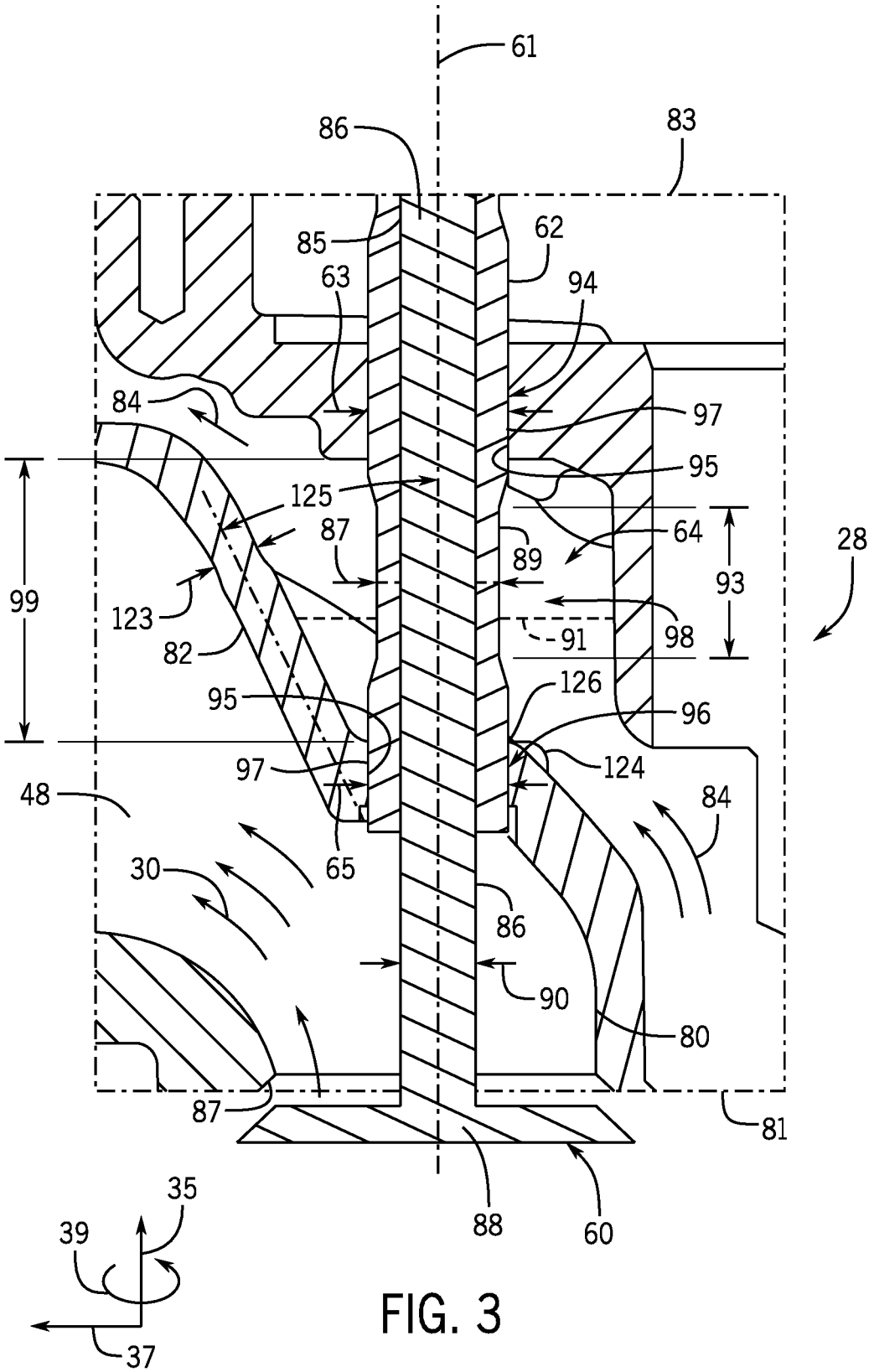
FIG. 3 is a partial cross-sectional side view of a portion of the engine head of FIG. 2, illustrating an embodiment of the exhaust valve, exhaust valve guide, cooling flow path, and exhaust flow path.

FIG. 3 is a side cross-sectional view of a portion of an embodiment of the engine head 28. In particular, FIG. 3 illustrates an embodiment of the exhaust passage 48, the coolant passage 64, the exhaust valve 60, and the exhaust valve guide 62. In the illustrated embodiment, the exhaust valve 60 includes a valve stem 86 and a valve head 88. The valve stem 86 has an approximately constant stem diameter 90, and the valve stem 86 extends in the axial direction 35 through an aperture 85 (e.g., cylindrical bore) of the exhaust valve guide 62. At the interface of the valve stem 86 and an inner surface (e.g., annular inner surface) of the aperture 85 of the exhaust valve guide 62 is a lubricant (e.g., liquid lubricant, hydrocarbon based lubricant, or oil) that reduces friction to provide smoother movement of the valve stem 86 relative to the exhaust valve guide 62. In operation, the exhaust valve 60 is configured to selectively open and close the valve head 88 relative to a valve seat 87 (e.g., tapered annular valve seat) about the exhaust passage 48 by moving the valve stem 86 axially along the aperture 85 in the valve guide 62. In this manner, the valve head 88 enables the exhaust valve 60 to selectively fluidly couple the combustion chamber 12 and the exhaust passage 48. Further, the exhaust valve guide 62 is coupled to the engine head 28 at a first sealing register 94 and a second sealing register 96. Each of the sealing registers 94 and 96 may be an annular sealing register, which may be machined into the engine head 28. For example, the sealing registers 94 and 96 may have an annular sealing surface 95, which receives a corresponding annular sealing surface 97 of the valve guide 62.

In the present embodiment, the exhaust valve 60 is in an open position (e.g., lowered position) with the valve head 88 unseated away from the valve seat 87, such that the exhaust 30 can flow from the combustion chamber 12 to the exhaust passage 48. As the exhaust 30 flows through the exhaust passage 48, the heat from the exhaust 30 is transferred to the exhaust valve 60, the exhaust valve guide 62, a first exhaust wall 80, and a second exhaust wall 82. The cooling passage 64 provides a flow of coolant 84 to absorb at least some of the heat transferred by the exhaust 30 and carry the heat away from the exhaust valve 60, the exhaust valve guide 62, the first exhaust wall 80, and the second exhaust wall 82. In the illustrated embodiment, the coolant 84 flows in a generally outward direction (e.g., upward axial direction 35) from a bottom portion 81 of the engine head 28 (e.g., closest to the combustion chamber 12) to a top portion 83 of the engine head 28 (e.g., further away from the combustion chamber 12). As the coolant 84 flows across a surface (e.g., annular exterior surface) of the exhaust valve guide 62, the coolant 84 absorbs at least a portion of the heat from the exhaust valve guide 62. The exhaust valve guide 62 includes an annular cooling portion 98 (e.g., annular recessed portion 89) configured to increase the amount of heat absorbed by the coolant 84. In operation, the heat transfers from the exhaust 30, through the exhaust valve 60, into the exhaust valve guide 62, and into the coolant 84. The annular cooling portion 98 (e.g., annular recessed portion 89) enables the heat to travel through less material of the exhaust valve guide 62 as the heat passes from the exhaust valve 60 to the coolant 84, thus increasing the heat transfer rate (e.g., conductive heat transfer) between the exhaust valve guide 62 and the coolant 84. The annular cooling portion 98 (e.g., annular recessed portion 89) also increases the cross-sectional flow area 91 of the cooling passage 64 surrounding the valve guide 62, such that a greater amount of flow of the coolant 84 is achieved around the valve guide 62.

In the illustrated embodiment, the annular cooling portion 98 has the annular recessed portion 89 extending axially along a distance or length 93 of the valve guide 62, which is positioned along a total distance or length 99 axially between the first sealing register 94 and the second sealing register 96. In certain embodiments, the length 93 of the annular cooling portion 98 (e.g., annular recessed portion 89) may be at least equal to or greater than approximately 10, 20, 30, 40, 50, 60, 70, 80, 90, 95, 97.5, 99, or 100 percent of the length 99. Furthermore, the valve guide 62 may have a cross-sectional area 63 at the first sealing register 94, a cross-sectional area 65 at the second sealing register 96, and a cross-sectional area 67 at the annular cooling portion 98 (e.g., annular recessed portion 89), wherein the cross-sectional area 67 is less than the cross-sectional areas 63 and 65. For example, in certain embodiments, the cross-sectional area 67 may be less than or equal to approximately 20, 30, 40, 50, 60, 70, or 80 percent of the cross-sectional areas 63 and 65. The ratio of cross-sectional area 67 versus cross-sectional areas 63 and 65 may be constant lengthwise along the length 93, or the ratio may vary (e.g., increase or decrease) along the length 93.

As further illustrated in FIG. 3, the structure of the engine head 28 surrounding the valve guide 62 and defining the coolant passage 64 includes additional thermal control features to improve cooling of the exhaust valve 60 and the exhaust valve guide 62. For example, as discussed in further detail below, the first exhaust wall 80 includes a bump 124 proximal to an edge 126 (e.g., inner annular end) of the second sealing register 96. The bump 124 provides an increased thickness of the first exhaust wall 80 at the edge 126, thereby helping to provide more uniform heat transfer from the exhaust valve 60 and the exhaust valve guide 62 through the first exhaust wall 80 into the coolant 84 in the coolant passage 64. Otherwise, without the bump 124, the first exhaust wall 80 would have a relatively small thickness at the edge 126, which could lead to increased thermal stress at the edge 126. Additionally, as discussed in detail below, the second exhaust wall 82 may have a thickness 123 and an angle 125 (see FIG. 5) along the annular cooling portion 98 (e.g., annular recessed portion 89), wherein the thickness 123 and the angle 125 are selected to help increase heat transfer away from the exhaust valve 60 and the exhaust valve guide 62 while maintaining sufficient flow area in the exhaust passage 48.

Figure 4:
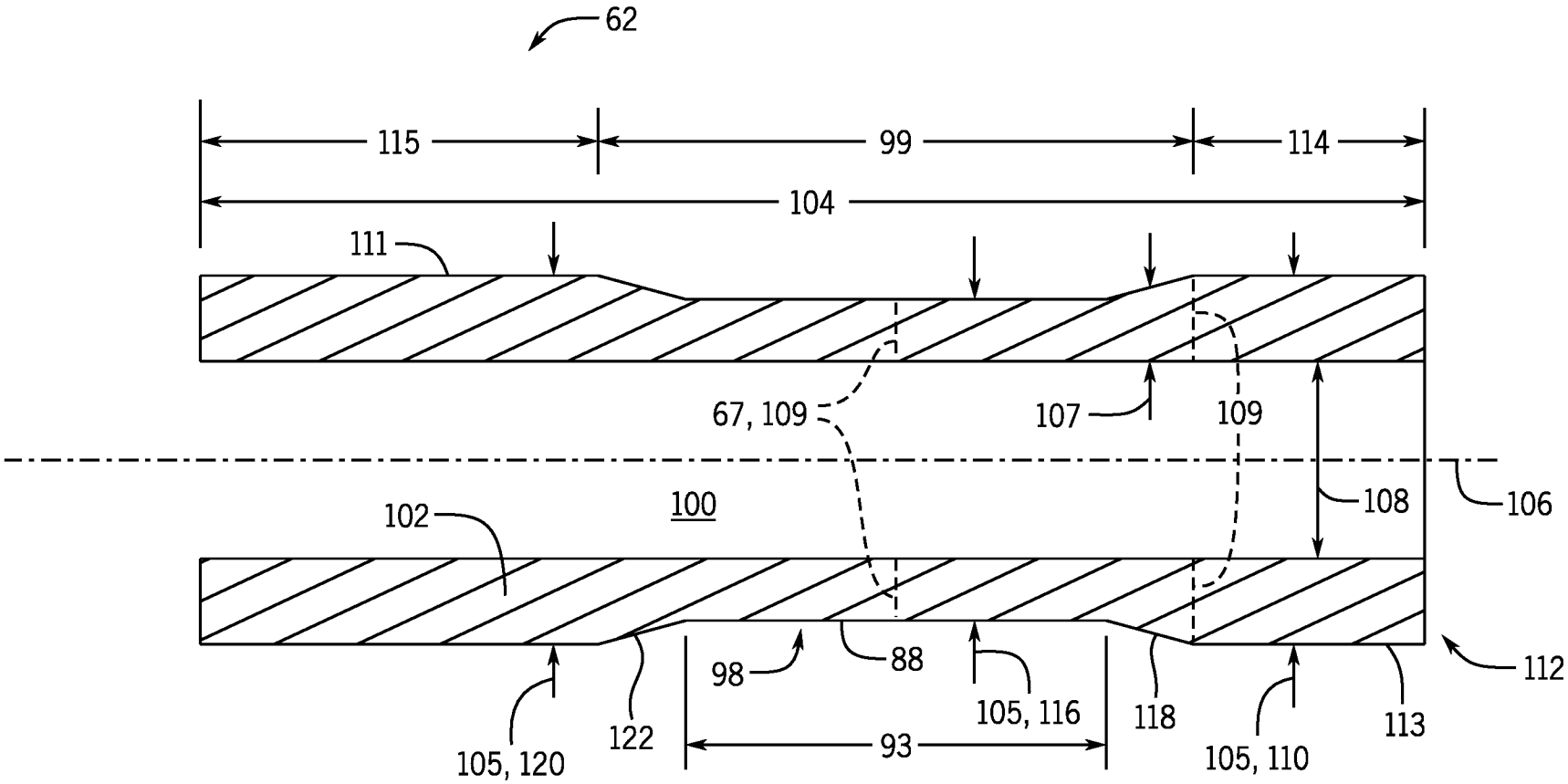
FIG. 4 is a cross-sectional side view of an embodiment of the exhaust valve guide of FIG. 3.

FIG. 4 is a side cross-sectional view of an embodiment of the exhaust valve guide 62 having an annular passage 100 (e.g., a cylindrical valve bore) along a central axis 106, wherein the annular passage 100 is configured to support the valve stem 86 of the exhaust valve 60. The exhaust valve guide 62 also has an annular guide body 102 that has varying thicknesses, diameters, and cross-sectional areas along a length 104. In the illustrated embodiment, an inner diameter 108 of the annular passage 100 remains approximately constant along the length 104, which enables the valve stem 86 having an approximately constant diameter to translate with respect to the exhaust valve guide 62 along the central axis 106. In some embodiments, the inner diameter 108 may be approximately 0.4 to 0.7 inches, 0.45 to 0.65 inches, 0.5 to 0.6 inches, or 0.53 to 0.58 inches.

Along the length 104 of the exhaust valve guide 62, the outer diameter varies to increase the rate of heat transfer between the coolant 84 and the exhaust valve guide 62. For example, the exhaust valve guide 62 has a first outer diameter 110 proximal to a distal end 112 and/or extending along all or part of a seal mounting region 113 (e.g., a sealing register length 114) of the exhaust valve guide 62. The first outer diameter 110 (e.g., along the length 114) is sized to fit the exhaust valve guide 62 within the second sealing register 96 and fluidly separate the exhaust passage 48 from the coolant passage 64. In certain embodiments, the first outer diameter 110 may extend along approximately 1.001 to 1.0045 inches, 1.0015 to 1.004 inches, 1.002 to 1.0035 inches, or 1.0025 to 1.003 inches of the length of the exhaust valve guide 62, which may correspond to all or part of the sealing register length 114. Further, the first outer diameter 110 may remain approximately constant across the sealing register length 114 of the exhaust valve guide 62.

The sealing register length 114 (e.g., length of sealing register 96) may be a length that enables a particular heat transfer rate between the exhaust valve guide 62 and the coolant 84. For example, if the sealing register length 114 is too long, the heat transfer rate will be too small. Conversely, if the sealing register length 114 is too short, the heat transfer rate will be too high, causing the coolant to boil. Accordingly, the sealing register length 114 may be any suitable length to achieve the desired heat transfer rate, including approximately 0.5 to 0.8 inches, 0.55 to 0.75 inches, 0.6 to 0.7 inches, or 0.62 to 0.68 inches.

Adjacent the sealing register length 114, an outer diameter 105 of the exhaust valve guide 62 decreases from the first outer diameter 110 to a second outer diameter 116 along a taper 118 (e.g., tapered annular surface or conical surface). The taper 118 may be at any suitable angle, including 5 degrees, 10 degrees, 15 degrees, 20 degrees, 25 degrees, 30 degrees, 35 degrees, 40 degrees, 45 degrees, or more degrees. Further, a thickness 107 and a cross-sectional area 109 of the annular guide body 102 decreases along the taper 118 from the sealing register length 114 to the annular cooling portion 98 (e.g., annular recessed portion 89), because the inner diameter 108 remains approximately constant while the outer diameter 105 decreases. The smaller second outer diameter 116, smaller thickness 107, and smaller cross-sectional area 67, 109 at the annular cooling portion 98 (e.g., annular recessed portion 89) is configured to provide a higher rate of heat transfer between the exhaust valve guide 62 and the coolant 84, as compared with an exhaust valve guide 62 without the annular cooling portion 98 (e.g., annular recessed portion 89). Accordingly, length 93 of the annular cooling portion 98 (e.g., annular recessed portion 89) having the second outer diameter 116 may be any suitable length, such as approximately 0.775 to 0.975 inches, 0.800 to 0.950 inches, 0.825 to 0.925 inches, or 0.850 to 0.900 inches. In the present embodiment, the second outer diameter 116 remains approximately constant across the length 93 of the annular cooling portion 98 (e.g., annular recessed portion 89). In some embodiments, the second outer diameter 116 may vary across the length 93 of the annular cooling portion 98 (e.g., annular recessed portion 89). Furthermore, in certain embodiments, the length 93 of the annular cooling portion 98 may include a plurality of annular recessed portions 89 that are axially spaced apart from one another.

After the annular cooling portion 98, the outer diameter 105 of the exhaust valve guide 62 increases from the second outer diameter 116 to a third outer diameter 120 along a taper 122 (e.g., tapered annular surface or conical surface). The taper 122 may be at any suitable angle, including 5 degrees, 10 degrees, 15 degrees, 20 degrees, 25 degrees, 30 degrees, 35 degrees, 40 degrees, 45 degrees, or more degrees. The exhaust valve guide 62 has the third outer diameter 120 extending along all or part of a seal mounting region 111 (e.g., a sealing register length 115) of the exhaust valve guide 62. The third outer diameter 120 (e.g., along the length 115) is sized to fit the exhaust valve guide 62 within the first sealing register 94 and fluidly separate the coolant passage 64 from an exterior (e.g., atmosphere) surrounding the engine head 28. The length 115 of the third outer diameter 120 may be approximately equal to, less than, or greater than the length 114 of the first outer diameter 110. In some embodiments, the length 115 of the third outer diameter 120 may be any suitable length, including 1.001 to 1.0045 inches, 1.0015 to 1.004 inches, 1.002 to 1.0035 inches, 1.0025 to 1.003 inches, etc.

The lengths discussed above may correspond to an engine head having a particular size. Accordingly, it may be beneficial to discuss the dimensions as ratios with respect to one another. For example, a ratio of the inner diameter 108 to the second sealing register length 114 may be approximately 0.7 to 1, 0.75 to 0.95, 0.8 to 0.9, 0.83 to 0.88, etc. A ratio of the first outer diameter 110 to the second sealing register length 114 may be approximately 1.35 to 1.75, 1.40 to 1.70, 1.45 to 1.65, 1.50 to 1.60, 1.52 to 1.58, etc. A ratio of the second outer diameter 116 to the second sealing register length 114 may be approximately 1.10 to 1.60, 1.15 to 1.55, 1.20 to 1.50, 1.25 to 1.45, 1.30 to 1.40, 1.32 to 1.38, etc.

Again, as discussed above, the annular cooling portion 98 (e.g., annular recessed portion 89) is configured to increase cooling of the exhaust valve 60 and the exhaust valve guide 62 by at least one or more of the following: reducing the thickness 107 and cross-sectional area 67, 109 between the valve stem 86 and the coolant 84, and increasing the cross-sectional flow area 91 (see FIG. 3) of the coolant passage 64 surrounding the exhaust valve guide 62. As a result, the lubricant (e.g., oil) between the valve stem 86 and the exhaust valve guide 62 may be less likely to thermal degradation and/or coking, and the life and performance of the exhaust valve 60 and the exhaust valve guide 62 may be substantially increased.

Figure 5:
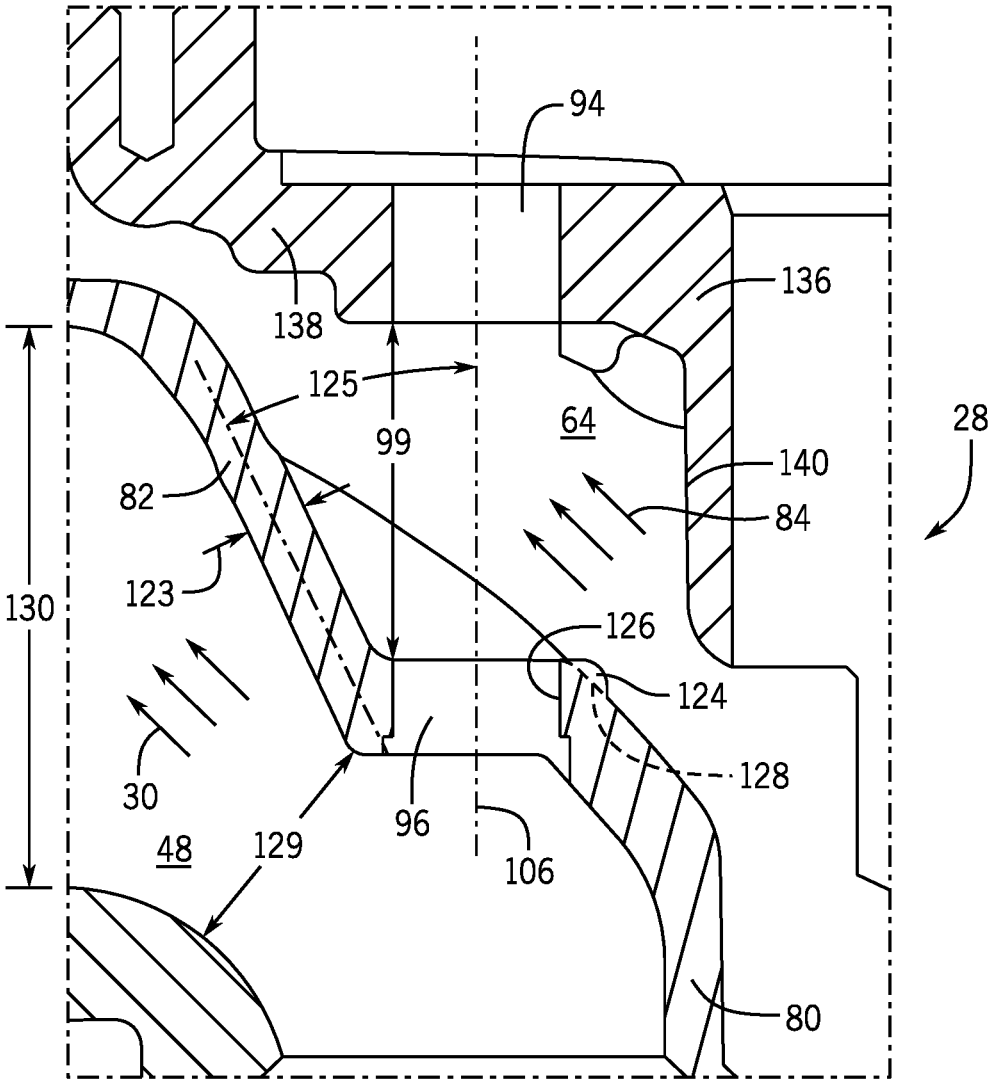
FIG. 5 is a cross-sectional side view of the engine head of FIGS. 2 and 3, illustrating the exhaust valve and the exhaust valve guide removed for purposes of discussing details of the exhaust flow path and the coolant flow path.

FIG. 5 is a side cross-sectional view of a portion of an embodiment of the engine head 28 with the exhaust passage 48 and the coolant passage 64. As discussed above, the exhaust passage 48 is fluidly separated from the coolant passage 64 by the first exhaust wall 80, the second exhaust wall 82, and the second sealing register 96. The structural characteristics of the first exhaust wall 80 and the second exhaust wall 82 enable the exhaust 30 to flow through the exhaust passage 48 with a sufficient flow rate and heat transfer rate.

In the illustrated embodiment, the exhaust passage has a throat 129 (e.g., minimum cross-sectional flow area) and an exhaust outlet 130 (e.g., outlet cross-sectional flow area), which may be sized to provide a desired exhaust flow, pressure ratio, expansion rate of the hot combustion gases in the exhaust 30, and so forth. In certain embodiments, the angle 125 may be selected to increase cooling of the exhaust valve 60 and the exhaust valve guide 62 (e.g., by increasing flow of the coolant 84 around the annular recessed portion 89) while ensuring that the cross-sectional areas of the throat 129 and the exhaust outlet 130 at least meet minimum desired values or ratios. For example, the angle 125 of the second exhaust wall 82 with respect to the central axis 106 may maintain at least a minimum cross-sectional area of the throat 129, which is the smallest cross-sectional area along the exhaust passage 48. Further, the angle 125 of the second exhaust wall 82 with respect to the central axis 106 may maintain at least a minimum cross-sectional area at the exhaust outlet 130. For example, in certain embodiments, a ratio of the cross-sectional areas of the throat 129 relative to the exhaust outlet 130 may be approximately 0.210 to 0.410, 0.235 to 0.385, 0.260 to 0.360, 0.285 to 0.335, or 0.300 to 0.320. Accordingly, in certain embodiments, the angle 125 of the second exhaust wall 82 may be at least equal to or greater than approximately 20 degrees, 21 degrees, 22 degrees, 23 degrees, 24 degrees, 25 degrees, 26 degrees, 27 degrees, 28 degrees, 29 degrees, 30 degrees, or any other suitable angle with respect to the central axis 106. For example, the angle 125 may be approximately 20 to 30 degrees, 22 to 28 degrees, or 24 to 26 degrees. Further, the angle 125 of the second exhaust wall 82 may be substantially constant (e.g., plus/minus 0, 0.5, 1, 2, 3, 4, or 5 degrees) along any suitable percentage of the length 99 between the sealing registers 94 and 96, such as along a length of at least equal to or greater than approximately 30 percent, 40 percent, 50 percent, 60 percent, 70 percent, 80 percent, 90 percent, or 100 percent of the length 99.

Further, a thickness 123 of the second exhaust wall 82 may enable a sufficient heat transfer rate from the exhaust passage 48 to the coolant passage 64 through the second exhaust wall 82. For example, if the thickness 123 is too large, the heat transfer rate may be too low, and if the thickness 123 is too small, the heat transfer rate may be too high. Accordingly, the thickness 123 may be approximately 0.300 to 0.500 inches, 0.320 to 0.460 inches, 0.340 to 0.420 inches, 0.350 to 0.400 inches, or 0.365 to 0.385 inches. In addition, the thickness 123 of the second exhaust wall 82 may be substantially constant (e.g., plus/minus 0, 0.5, 1, 2, 3, 4, or 5 percent) along any suitable percentage of the length 99 between the sealing registers 94 and 96, such as along a length of at least equal to or greater than approximately 30 percent, 40 percent, 50 percent, 60 percent, 70 percent, 80 percent, 90 percent, or 100 percent of the length 99. Further, the thickness 123 may be expressed as a ratio of the thickness 123 to the length 99. For example, the ratio may be approximately 0.1 to 0.3, 0.15 to 0.25, 0.175 to 0.225, or 0.19 to 0.21. In some embodiments, the thickness 123 may not be substantially constant, and may vary to include any thickness contained within the above described thicknesses.

The first exhaust wall 80 includes a bump 124 proximal to an edge 126 of the second sealing register 96. The bump 124 provides an increased thickness of the first exhaust wall 80 at the edge 126. At the bump 124, the increased thickness may lower the heat transfer rate between the first exhaust wall 80 and the coolant 84 in the coolant passage 64. For example, if the first exhaust wall 80 did not include the bump 124 and ended at a line 128 (i.e., following the inner curvature or contour of the first exhaust wall 80), then the thickness of the first exhaust wall 80 would progressively decrease and eventually reach a point at the edge 126, which would cause a much higher heat transfer rate between the first exhaust wall 80 and the coolant 84. As a result, the bump 124 helps to provide a more uniform thickness of the first exhaust wall 80 around the sealing register 96 and the exhaust valve guide 62, thereby helping to provide a more uniform heat transfer, reduce thermal differentials, and reduce thermal stress along the sealing register 96.

The engine head 28 also includes a first coolant passage wall 136 and a second coolant passage wall 138 that are shaped to enable the coolant 84 to surround the exhaust valve guide 62. For example, the first coolant passage wall 136 includes a first surface 140 that extends substantially parallel to the centerline axis 106 to increase the volume of space around the exhaust valve guide 62 through which the coolant 84 may flow.

Technical effects of the disclosed embodiments include providing systems for enhancing the cooling provided to an exhaust valve guide 62. For example, a coolant passage 84 is provided that surrounds at least a portion of the exhaust valve guide 62 to increase the rate of heat transfer between the coolant 84 and the exhaust valve guide 62. Further, the exhaust valve guide 62 includes an annular cooling portion 98, 89 that has a reduced outer diameter and wall thickness that further increases the heat transfer rate between the exhaust valve guide 62 and the coolant 84. Moreover, the engine head 28 that is configured to receive the exhaust valve guide 62 includes walls that fluidly separate the coolant passage 64 from an exhaust passage 48. The walls of the engine head 28 may maintain a certain wall thickness that provides a heat transfer rate that provides adequate cooling, but prevents the coolant 84 from receiving too much heat. Further, the angle of the walls maintain a certain minimum cross-sectional area in the exhaust passage 48 to provide an adequate flow rate of the exhaust through the exhaust passage 48. As such, the cooling provided to the engine head 28 and exhaust valve guide 62 is increased without reducing the performance of the exhaust flow.

This written description uses examples to disclose the present embodiments, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system having a valve guide to receive an exhaust valve of a cylinder head of a reciprocating engine, the cylinder head defining an exhaust flow path and first and second sealing registers disposed on opposite sides of a coolant flow path, the first sealing register disposed adjacent the exhaust flow path, the valve guide comprising:

an annular guide body having a cooling portion disposed between first and second mounting portions, wherein the first and second mounting portions are configured to mount in the respective first and second sealing registers, the cooling portion has a smaller wall thickness than the first and second mounting portions, and the annular guide body comprises a maximum diameter at a first distal end portion comprising the first mounting portion; and a valve bore extending through the annular guide body along a central axis.

2. The system of claim 1, wherein a first length of the first mounting portion is shorter than a second length of the second mounting portion along the central axis.

3. The system of claim 2, wherein the first length is between 0.5 to 0.8 inches, and the second length is between 1.001 to 1.0045 inches.

4. The system of claim 1, wherein the first mounting portion has a first length and a first outer diameter, and a ratio of the first outer diameter to the first length is between 1.35 to 1.75.

5. The system of claim 4, wherein the ratio of the first outer diameter to the first length is between 1.5 to 1.6.

6. The system of claim 1, comprising the exhaust valve having a valve stem configured to move axially along the valve bore of the valve guide.

7. The system of claim 1, comprising the cylinder head having the valve guide.

8. The system of claim 7, comprising the reciprocating engine having the cylinder head, the valve guide, and the exhaust valve.

9. A system having a valve guide to receive an exhaust valve of a cylinder head of a reciprocating engine, the cylinder head defining an exhaust flow path and first and second sealing registers disposed on opposite sides of a coolant flow path, the first sealing register disposed adjacent the exhaust flow path, the valve guide comprising:

an annular guide body having a cooling portion disposed between first and second mounting portions, wherein the first and second mounting portions are configured to mount in the respective first and second sealing registers, the cooling portion has a smaller wall thickness than the first and second mounting portions, the first mounting portion has a first constant outer diameter along a first length configured to extend along a first entire interface with the first sealing register, the second mounting portion has a second constant outer diameter along a second length configured to extend along a second entire interface with the second sealing register, and the first length is shorter than the second length along a central axis; and a valve bore extending through the annular guide body along the central axis.

10. The system of claim 9, wherein the first length is between 0.5 to 0.8 inches, and the second length is between 1.001 to 1.0045 inches.

11. The system of claim 9, wherein the first constant outer diameter is greater than the second constant outer diameter.

12. The system of claim 9, wherein the first constant outer diameter is greater than the first length.

13. The system of claim 12, wherein the ratio of the first constant outer diameter to the first length is between 1.5 to 1.6.

14. The system of claim 9, wherein the cooling portion of the annular guide body has a third constant outer diameter along a third length, and the third constant outer diameter is less that the first and second constant outer diameters.

15. The system of claim 14, wherein the annular guide body only decreases in outer diameter from the first and second constant outer diameters to the third constant outer diameter.

16. The system of claim 9, wherein the valve guide comprises a maximum diameter at a first distal end portion comprising the first mounting portion.

17. The system of claim 9, wherein the valve guide is configured to be installed with the second mounting portion inserted into and through the first sealing register before inserting the first mounting portion into the first sealing register.

18. A system having a valve guide to receive an exhaust valve of a cylinder head of a reciprocating engine, the cylinder head defining an exhaust flow path and first and second sealing registers disposed on opposite sides of a coolant flow path, the first sealing register disposed adjacent the exhaust flow path, the valve guide comprising:

an annular guide body having a cooling portion disposed between first and second mounting portions, wherein the first and second mounting portions are configured to mount in the respective first and second sealing registers, the cooling portion has a smaller wall thickness than the first and second mounting portions, the first mounting portion has a first constant outer diameter along a first length configured to extend along a first entire interface with the first sealing register, and the first constant outer diameter is greater than the first length; and a valve bore extending through the annular guide body along a central axis.

19. The system of claim 18, wherein the ratio of the first constant outer diameter to the first length is between 1.5 to 1.6.

20. The system of claim 18, wherein the first constant outer diameter is greater than a second outer diameter of the second mounting portion.

* * * * *